US005147019A

United States Patent [19]

Van Hooreweder et al.

[11] Patent Number: 5,147,019

[45] Date of Patent: Sep. 15, 1992

[54] BRAKE SYSTEM FOR LUGGAGE CASE

[75] Inventors: Godwin Van Hooreweder, Brugge, Belgium; Georg A. W. Bartsch, Iserlohn, Fed. Rep. of Germany; Klaus-Dieter Hesse, Sundern-Amecke, Fed. Rep. of Germany; Ulf Rasch, Iserlohn, Fed. Rep. of Germany

[73] Assignee: Samsonite Corporation, Denver, Colo.

[21] Appl. No.: 603,591

[22] Filed: Oct. 25, 1990

[30] Foreign Application Priority Data

Oct. 27, 1989 [FR] France ..... 89 14168

[51] Int. Cl.[5] ..... A45C 5/14; A45C 13/22; A45C 13/28

[52] U.S. Cl. ..... 190/18 A; 190/115; 280/37; 280/47.26; 188/5

[58] Field of Search ..... 190/18 A; 280/37, 47.26; 188/1.12, 5

[56] References Cited

U.S. PATENT DOCUMENTS

| | | | |
|---|---|---|---|
| 854,602 | 5/1907 | Peterson | 190/18 A X |
| 1,027,686 | 5/1912 | Bollinger | 190/18 A X |
| 1,081,670 | 12/1913 | James | 190/18 A X |
| 1,092,506 | 4/1914 | Oldroyd | 190/18 A X |
| 1,197,190 | 9/1916 | Dunn et al. | 190/18 A X |
| 3,307,658 | 3/1967 | Stevenson | 188/5 |
| 3,946,839 | 3/1976 | Butler | 190/18 A |
| 4,122,924 | 10/1978 | Wasserman | 190/18 A |
| 4,273,222 | 6/1981 | Cassimally | 190/18 A |
| 4,411,343 | 10/1983 | Cassimally et al. | 190/18 A |
| 4,508,202 | 4/1985 | Siegert et al. | 190/18 A X |
| 4,979,598 | 12/1990 | Verheit et al. | 190/18 A |

FOREIGN PATENT DOCUMENTS

| | | | |
|---|---|---|---|
| 2510720 | 9/1976 | Fed. Rep. of Germany . | |
| 804974 | 11/1936 | France . | |
| 961977 | 5/1950 | France | 190/18 A |
| 1145985 | 11/1957 | France | 190/18 A |
| 8001671 | 8/1980 | PCT Int'l Appl. | 190/18 A |
| 693373 | 7/1953 | United Kingdom | 190/18 A |
| 2135638 | 9/1984 | United Kingdom | 190/18 A |
| 2197637 | 5/1988 | United Kingdom | 190/18 A |

*Primary Examiner*—Sue A. Weaver
*Attorney, Agent, or Firm*—Gregory W. O'Connor

[57] ABSTRACT

Luggage cases which include four wheels may uncontrollably roll down inclined conveyor belts and the like. Disclosed is a brake system for selectively disabling at least some of the four wheels 12,14 on such a case 10. Preferably, this brake system is selectively operated by a pull strap or the like. In one condition, the brake system deploys a ground engaging arm which supports one end of the case 10 and prevents the wheels to be disabled from engaging the inclined surface of the conveyor belt.

9 Claims, 3 Drawing Sheets

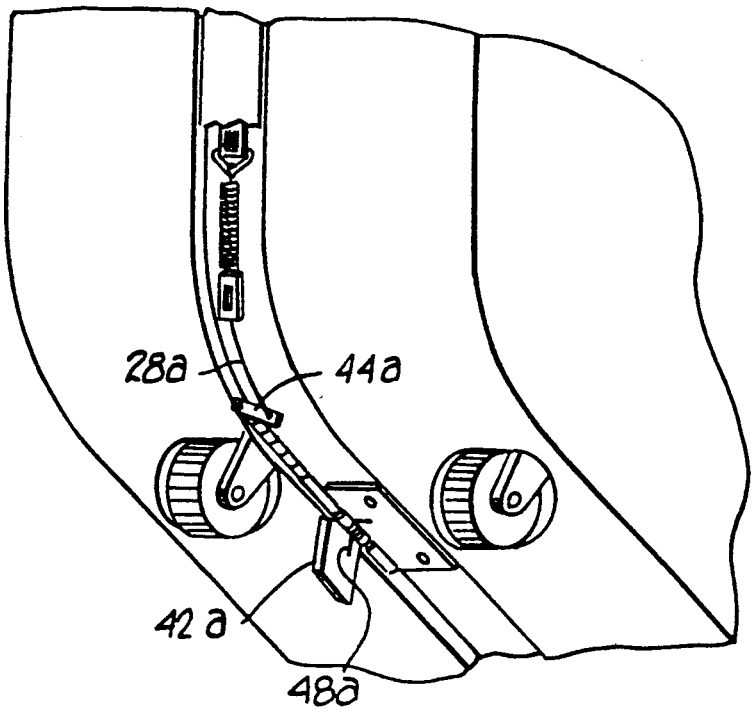
FIG. 5
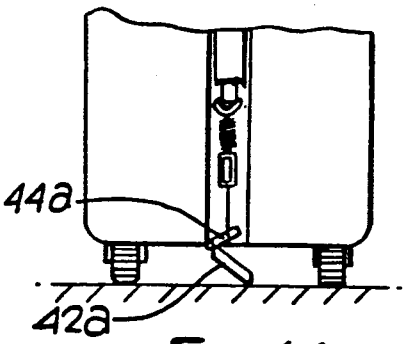
FIG. 6A
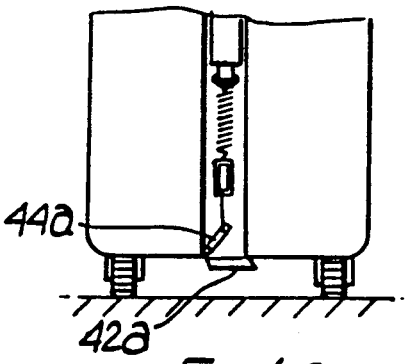
FIG 6C
FIG 6B
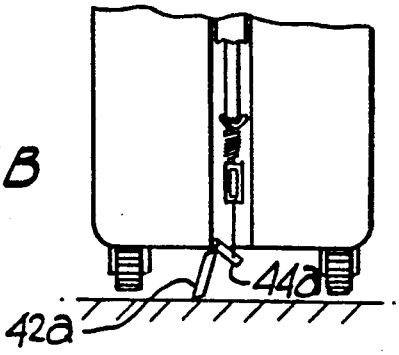

BRAKE SYSTEM FOR LUGGAGE CASE

BACKGROUND OF THE INVENTION

This invention relates to luggage cases having wheels. There are two basic wheel systems for such luggage cases. One system has only two wheels located at one end of the bottom of the luggage case and a pivotable handle at its opposite corner used to lift, pull and guide the luggage case on those two wheels. The second system usually has four wheels, two at each end of the case. In this latter system, a tether strap and a handle is used to roll the case on all four wheels.

A characteristic problem of the 4-wheel type pullman case is that the wheels are free wheeling, that is, the wheels permit the case to roll along the floor without hinderance. The 4-wheeled case can thus freely roll down inclined ramps or conveyors. Depending on inclination of the conveyor and distance travelled, the case can reach substantial velocities, sometimes damaging the case, contents and other pieces of luggage on impact.

BRIEF SUMMARY OF THE INVENTION

Accordingly, the invention comprises a system for a luggage case having wheels for movement along a horizontal or inclined surface and a means for towing this case. The improvement comprises a means for selectively disabling at least some of the wheels when unintended rolling movement is to be hindered. Preferably, this means for selectively disabling the wheels is operated by the means for towing. In the preferred embodiment, the luggage case includes four wheels, and the means for selectively disabling disables two of the four wheels. Typically, this means for disabling is located so as to disable the wheels on the same end of the case where the towing means is located.

The means for disabling the wheels preferably comprises a leg which has a dimension such that when the leg is in one orientation, it prevents the wheels from engaging the horizontal surface or floor on which the case rests, and when in another orientation, the wheels are permitted to roll on the floor. As will be seen in the preferred embodiment, the means for towing includes a strap and means for selectively storing the strap in a looped condition on the luggage case. The means for disabling the wheels includes a link connected to this means for selectively storing the strap. The link engages the leg such that when the towing strap is pulled, the link permits the leg to fold against the side of the case. When the end of the case is lifted off the ground, as by the carry handle, the leg is spring biased to extend beyond the wheels, thus preventing the wheels from engaging the floor until the tow strap storing means is operated again.

BRIEF DESCRIPTION OF THE DRAWINGS

FIG. 5 shows a second embodiment of the invention in a view similar to that of FIG. 2; and FIG. 6A, B and C show a schematic view of the corresponding three operative positions of the embodiment of FIG. 5 as viewed from the front end of the case.

DESCRIPTION OF THE PREFERRED EMBODIMENT

Figure 1:
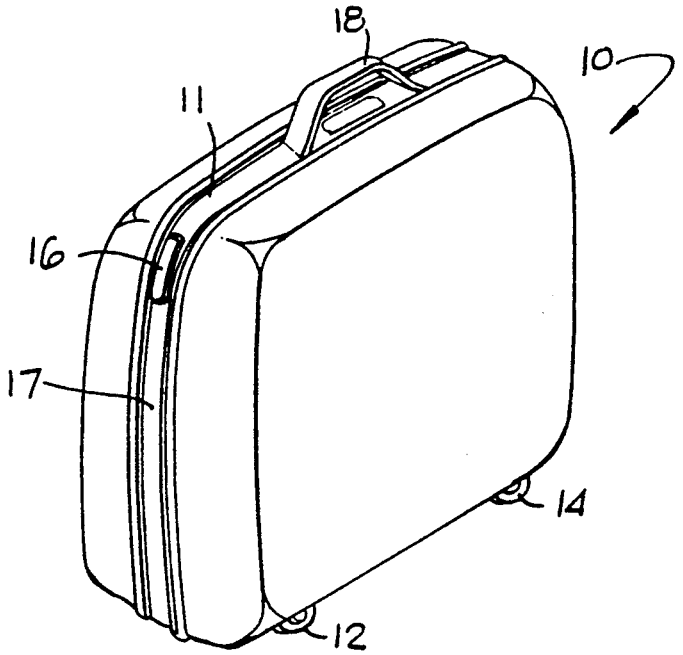
FIG. 1 shows a wheel type luggage case having the brake system of the subject invention.

The luggage case 10 includes a plurality of wheels or rollers. A front pair of rollers 12 is positioned at the end of the case 10 where a pull handle 16 is located. A second pair of rollers 14 is located at the rear end of the case 10 opposite from that having the pull handle 16. The wheels 12 and 14 are of conventional type, and are conventionally attached to the luggage case to constantly protrude below the case as shown in the figures. The luggage case 10, of course, includes a carry handle 18 of notorious type. The luggage case 10 has a peripheral groove 11 which aesthetically divides the case 10 into smaller visual portions, as well as provides a cavity in which the pull handle 16, its deployable pull strap (as will be further detailed) and the brake system may be conveniently housed. Also, the case 10 may be divided into a base shell and lid shell in this groove 11, the lid being connected for relative hinging movement about hinges 15. Typically the front wheels 12 are able to pivot about a vertical axis. Thus, the case 10 can be turned around corners when pulled by the pull handle 16. In the pull strap system anticipated, a strap 20 is stored in a looped condition within a casing 17, also contained in the peripheral groove 11.

Figure 2:
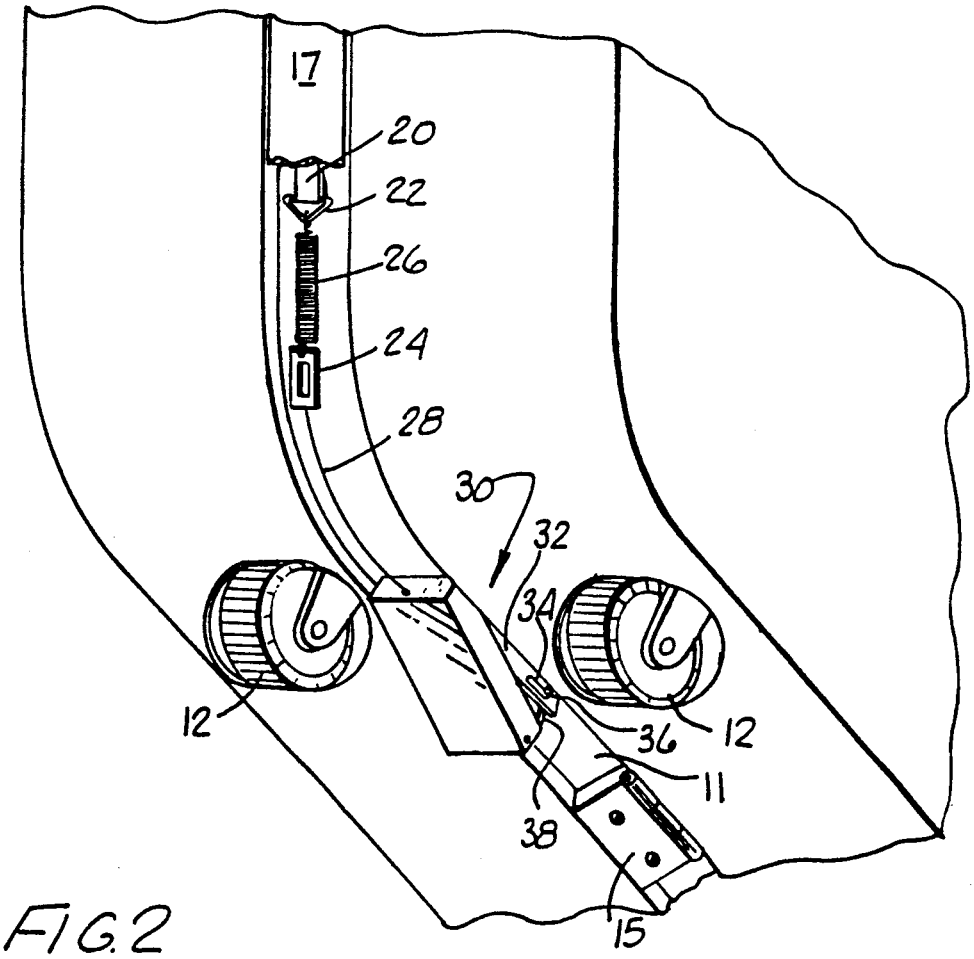
FIG. 2 shows a lower front corner of the luggage case of FIG. 1 which includes the brake system.

FIG. 2 shows the lower forward corner of the luggage case 10 with a portion of the casing 17 removed to show a middle portion of the pull strap 20, looped around moveable sheave 22. The sheave 22 is interconnected via a slide 24, spring 26 and cable 28 to brake mechanism 30. The cable 28 may be of the sheathed type to permit the cable to move easily in the groove 11 around the lower forward corner of the case 10.

Figure 3:
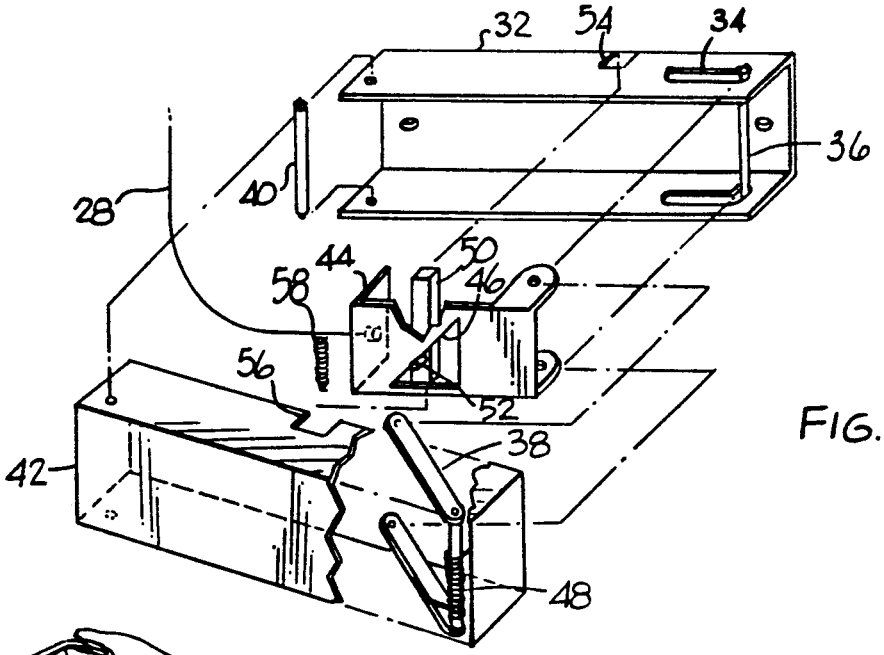
FIG. 3 is an exploded view of the brake system.

The brake mechanism 30 consists of a base portion 32 which is bolted or riveted into the peripheral groove 11. The base portion includes a pair of slots 34 in which axle 36 can both pivot and translate. The axle 36 also carries the upper end of support link 38 and one end of shuttle 44 (FIG. 3).

The base portion pivotally supports second axle 40, which is in turn attached to a first end of ground engaging leg 42. The cable 28 is attached to shuttle 44, which moves along the length of the base portion 32 a short distance and carries at its one end the axle 36 and the connected support link 38 in response to the movement of cable 28 and to the forces on the lower end of the ground engaging leg 42. At the lower end of support link 38 is a small torsion spring 48. This torsion spring 48 provides a slight biasing force which tends to move the upper end of support link 38 to the right as shown in the figures along the slit 34. The force of this biasing spring 48 can easily be overcome by movement of the shuttle 44 in response to an upward movement of the slide 24 as transmitted by the cable 28.

Figure 4A:
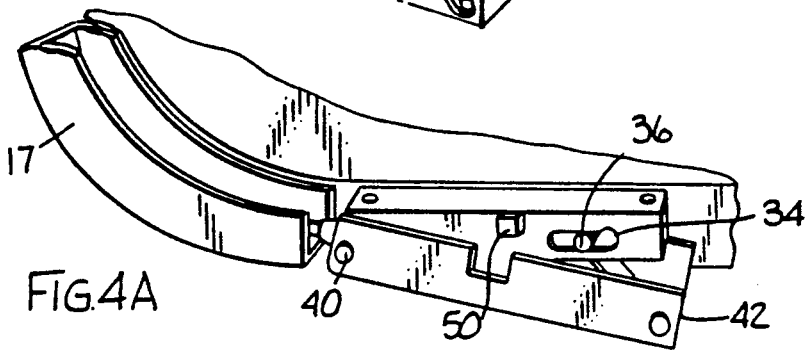
FIG. 4A, B and C show three basic operating positions of the brake system.

Operation of the brake 30 will now be detailed with reference to FIG. 4. FIG. 4A shows what could be considered the normal position of the brake 30 with the ground engaging leg 42 touching the floor while all the wheels are also engaging the floor. In this condition, the ground engaging leg 42 is biased to touch the floor only by the spring bias provided by the torsion spring 48. Here, the ground engaging leg has negligible braking effect and the case 10 is free to move on its four wheels. Slight variations in the surface of the floor may cause the ground engaging leg 42 to pivot about second axle 40. The axle 36 rides freely along the central portion of the cam surfaces of the slots 34. This smooth portion of the slots 34 do not hinder this slight movement.

Figure 4C:
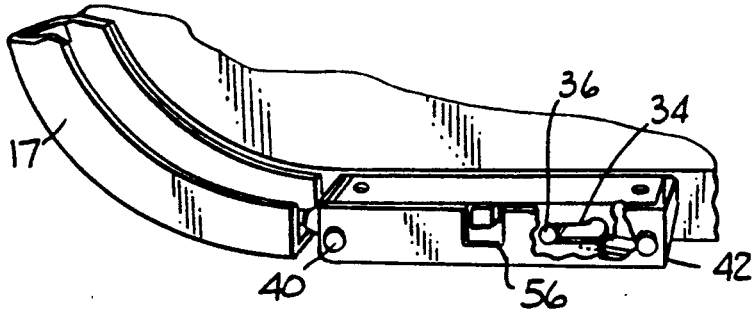
Figure 4B:
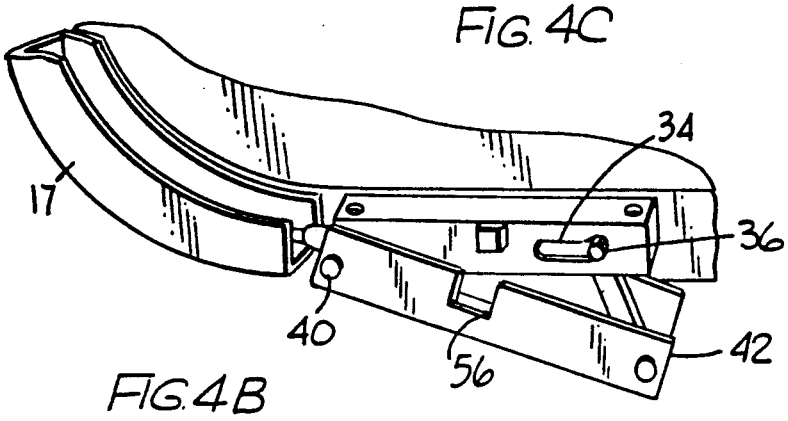

However, when the braking effect is desired, the case 10 is lifted slightly off the ground by its carry handle 18. This permits the spring bias provided by the torsion spring 48 to place the axle 36 in the extreme right-most position in the slots 34. As can be seen in FIG. 4B, this places axle 36 past the cam surface in slots 34 and in a vertically oriented portion thereof. When the case 10 is placed back down on the floor, the end of the ground engaging leg 42 is held below the lower-most surface of the forward wheels 12, supporting them up off the floor and thus disabling the wheels 12 from rolling engagement. The axle 36 is locked against displacement. In this condition, free wheeling movement of the case 10 is substantially resisted.

When the operator of the case wishes free wheeling engagement, such as during towing of the case 10 via the pull handle 16, the user need only withdraw the strap 20 by pulling on the handle 16. This causes the slide 24 to move upward. This pulls cable 28 and its attached shuttle 44 to the left as shown in FIG. 3. This displaces axle 36 from the locked position in the slots 34 and withdraws the ground engaging leg 42 completely away from the floor and at least partially into the peripheral groove 11, as can be seen in FIG. 4C. Thus, the case 10 operates as if no brake mechanism exists. It can move freely on front castor wheels 12 and rear wheels 14.

On release of the pull handle, the tension in cable 28 is relieved and the ground engaging leg 42 is free to return to the configuration as shown in FIG. 4B. Again, there is no substantial braking force in this position. Only when the wheels 12 are lifted, as by the carry handle 18, is the ground engaging leg permitted to drop far enough towards the ground to permit axle 36 on support link 38 to fall in the locked position in slots 34.

Thus, the pull handle 16, whether it be a simple strap mechanism or the more complex deployable strap mechanism of the preferred embodiment, can be used in conjunction with the carry handle 18 to toggle the brake system on and off.

The movement of the shuttle 44 can also be controlled depending on whether the luggage case lid is open or closed. In the preferred embodiment where the brake mechanism is contained in the peripheral groove 11, it is important that the ground engaging leg 42 not interfere with the opening of the case. To this end, a plunger 50 is provided for lateral movement between a position wherein it projects a substantial distance through a hole 54 in the side of the base portion 32 and through notch 56 in the side of the ground engaging leg 42, and a second position substantially flush with the hole 54. A spring 58 is provided in the hollow lower end of the plunger 50 to bias this plunger upwardly into its first position. Projecting laterally from the side of the plunger 50 is a cam follower 52 which can engage a ramped cam surface 46 formed by a hole through the lower face of the shuttle 44. The upper end of the plunger 50 engages the upper surface of the peripheral groove 11 when the case lid is closed. However, when the case lid is open, the biasing spring 58 forces the plunger 50 upwardly beyond the hole 54.

Normally, the upper end of the plunger 50 is pushed downwardly by engaging one side of the peripheral groove 11 carried by the lid of the case 10. This disengages the cam follower 52 from the ramped surface of cam 46 on the shuttle 44. However, when the lid of the luggage case 10 is opened via hinges 15, the plunger moves up through hole 54. The cam follower 52 is permitted to move in response to its biasing spring 58, and engages the ramped surface of the cam 46 to forceably move shuttle 44 and with it axle 36 forward in cam slots 34. This action operates to withdraw the ground engaging leg 42 from its extended position and moves it substantially into the peripheral groove 11. Thus, the ground engaging leg is placed in a position so that it does not interfere with the opening of the case 10 as it would otherwise do if allowed to remain in the extended position.

FIG. 5 shows a simplified brake system similar to that of the preferred embodiment. In this mechanism, the axis of rotation of the ground engaging leg **42*a* is at right angles to that shown in the preferred embodiment. The cam surfaces of the slot 34 in the preferred embodiment is functionally replaced by a simple over center positioning of the leg 42*a*. A biasing spring 48*a* normally holds the leg 42*a* in the over center position. Cable 28*a* is attached to the far end of a lever arm 44*a*, which is attached to the hinge pin controlling the position of the ground engaging leg 42*a*. When the tether strap is withdrawn as with a previous system, the movement thereof is transferred via cable 28*a* as previously described. Here, however, this movement is translated into a rotational force which overcomes the over centering biasing force provided by the spring 48*a***.

FIG. 6A shows the spring biased position wherein the ground engaging leg barely touches the floor and provides virtually no braking force. In FIG. 6B, the slight spring bias provided by **48*a* has brought the ground engaging leg 42*a* to its center position after the case has been lifted slightly. The weight of the case 10 effectively locks the leg 42*a* in a ground engaging position, disabling the wheels 12** since they are suspended in the air.

On withdrawing the tether strap from the case in a manner similar to that explained above, the motion is transmitted via the cable **28*a* to the end of the lever arm 44*a*, which translates the linear movement of cable 28*a* to a rotational force to overcome the bias of the spring 48*a*. Thus, on lifting at least the one end of the case by the tether strap, the ground engaging leg 42*a* is permitted to rotate in response to the force provided by 44*a*. This completely disengages the ground engaging leg 42*a* from the floor as shown in FIG. 6C. In this condition, the case 10** is free to ride on all four wheels as in a conventional 4-wheeled luggage case.

Again, similar to the preferred embodiment set forth above, the embodiment of FIG. 5 includes means for preventing the brake mechanism from interfering with the opening of the lid portion of the case. In this instance, the axis of the hinge connecting the lid of the case to the base of the case is located approximate to the pivot point of the ground engaging leg **42*a*. Since the ground engaging leg 42*a* pivots about an axis parallel to the hinge line, the lid of the case merely engages the upper shoulder of the ground engaging leg when it is opened. The force of the lid opening overrides the spring biasing force provided by the spring 48*a*** and causes the leg to fold away from the lid of the case.

While these preferred embodiments are expressed in terms of a luggage case, other applications become evident on viewing of this specification. For example, any 4-wheeled manually pulled or pushed cart could use this system of disabling two of those wheels selectively on operation of the operating handle.

We claim:

1. In a luggage case and the like having wheels or casters mounted to constantly protrude below the case for enabling rolling movement along a horizontal or inclined surface, said case includes means for towing the case on the wheels or casters, the improvement comprising means for selectively disabling at least some of said wheels or casters when unintended rolling movement is to be hindered, and means for operatively connecting said means for towing to said means for selectively disabling, whereby said means for selectively disabling said wheels or casters is operated by said means for towing.

2. A luggage case as set forth in claim 1 wherein said luggage case includes four wheels or casters, said means for selectively disabling said wheels comprises means for disabling only two of said four wheels or casters.

3. A luggage case as set forth in claim 1, wherein said means for selectively disabling includes means for supporting said luggage case above said surface so as to prevent at least some of said wheels or casters from contacting said surface, whereby said unintended rolling movement is prevented on most horizontal and inclined surfaces.

4. A luggage case as set forth in claim 3 wherein said means for towing includes a strap and means for selectively storing said strap in a looped condition, said means for operatively connecting a link connected to said means for selectively storing said strap, said link moving said means for supporting out of engagement with said surface whereby said case is permitted to roll freely when said means for storing is used to deploy said strap, and said link moving said means for supporting into engagement with said surface whereby said wheels are disabled when said case is lifted from said horizontal or inclined surface.

5. A luggage case as set forth in claim 1 wherein said means for towing comprises a handle member extendably connected to one end of said luggage case, and said means for disabling said wheels or casters operates to disable the wheels or casters located nearest said one end of said luggage case.

6. A luggage case as set forth in claim 1 wherein said means for disabling said wheels comprises a leg having a dimension which, when in one orientation, prevents the wheels or casters from engaging the surface, and when in another orientation, permits rolling engagement of the surface by the wheels.

7. A luggage case as set forth in claim 1 including means to toggle said means for disabling on when said luggage case is lifted, and off when said means for towing is used to pull said luggage case.

8. A luggage case as set forth in claim 1 wherein said case includes a lid portion and a hinge means for attaching said lid portion to the rest of the case, said hinge means being located approximate to said means for selectively disabling, and wherein said means for disabling is further provided with means for operating said means for selectively disabling to prevent interference between said means for selectively disabling and said lid portion of said case when said lid portion is in the open condition.

9. A luggage case as set forth in claim 1 wherein said means for towing includes a casing attached to one end of the luggage case, a pull strap, a sheave normally engaging a center portion of said pull strap, a first spring for biasing said sheave whereby said pull strap is normally in said casing when said means for towing is not being pulled, a cable attached to said spring, and wherein said means for selectively disabling includes a ground engaging leg, a second spring for biasing said leg for holding said ground engaging leg to normally engage said surface, said case further including a cable attached to said first spring and connected to said ground engaging leg in a manner to overcome the spring bias force of said second spring when said pull strap is withdrawn from said casing, but the spring bias of said second spring means is not overcome when said pull strap is not pulled and is contained in said casing.

* * * * *